US011434674B2

(12) United States Patent
Goss

(10) Patent No.: US 11,434,674 B2
(45) Date of Patent: Sep. 6, 2022

(54) SYSTEMS, DEVICES, AND/OR METHODS FOR MANAGING BUILDING DOORS

(71) Applicant: Christian Joseph Goss, Valparaiso, IN (US)

(72) Inventor: Christian Joseph Goss, Valparaiso, IN (US)

( * ) Notice: Subject to any disclaimer, the term of this patent is extended or adjusted under 35 U.S.C. 154(b) by 296 days.

(21) Appl. No.: 16/575,422

(22) Filed: Sep. 19, 2019

(65) Prior Publication Data

US 2020/0102775 A1 Apr. 2, 2020

Related U.S. Application Data

(60) Provisional application No. 62/740,338, filed on Oct. 2, 2018.

(51) Int. Cl.
*E05B 15/02* (2006.01)
*E05C 19/00* (2006.01)

(52) U.S. Cl.
CPC ..... *E05C 19/003* (2013.01); *E05B 15/0205* (2013.01); *E05Y 2900/132* (2013.01)

(58) Field of Classification Search
CPC .... E05C 19/003; E05B 15/0205; E05B 63/12; E05B 63/0004; E05Y 2900/132
See application file for complete search history.

(56) References Cited

U.S. PATENT DOCUMENTS 3,583,738 A * 6/1971 Uphoff ..... E05C 19/10 292/67
D794,417 S * 8/2017 Hogan ..... D8/343
10,689,890 B2 * 6/2020 Taylor ..... E05B 63/0004

* cited by examiner

*Primary Examiner* — Kristina R Fulton
*Assistant Examiner* — Thomas L Neubauer
(74) *Attorney, Agent, or Firm* — Dale Jensen, PLC; Dale Jensen

(57) ABSTRACT

Certain exemplary embodiments can provide a system comprising a schoollock-mount coupleable to a doorframe of a door; a schoollock-pin slidably coupleable to the schoollock-mount; a schoollock-arm slidably coupleable to the schoollock-pin; and a schoollock-door-latch. The schoollock-door-latch is coupleable to the door via the one or more apertures.

4 Claims, 14 Drawing Sheets

1000

A

5000

6000

7000

8000

9000

10000

11000

12000

13000

14000

SYSTEMS, DEVICES, AND/OR METHODS FOR MANAGING BUILDING DOORS

CROSS-REFERENCES TO RELATED APPLICATIONS

This application claims priority to, and incorporates by reference herein in its entirety, U.S. Provisional Patent Application Ser. No. 62/740,338, filed Oct. 2, 2018.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments provide devices, systems, and/or methods, which are constructed to secure doors against unlawful, unwanted, and/or unauthorized entry. Home and/or room break-ins are a significant safety concern for people. Certain exemplary embodiments provide improved devices, systems, and/or methods for improving door security. School door applications are particularly well suited applications for certain exemplary embodiments.

Certain exemplary embodiments can provide a system comprising a schoollock-mount coupleable to a doorframe of a door; a schoollock-pin slidably coupleable to the schoollock-mount; a schoollock-arm slidably coupleable to the schoollock-pin; and a schoollock-door-latch. The schoollock-door-latch is coupleable to the door via the one or more apertures.

Figure 1:
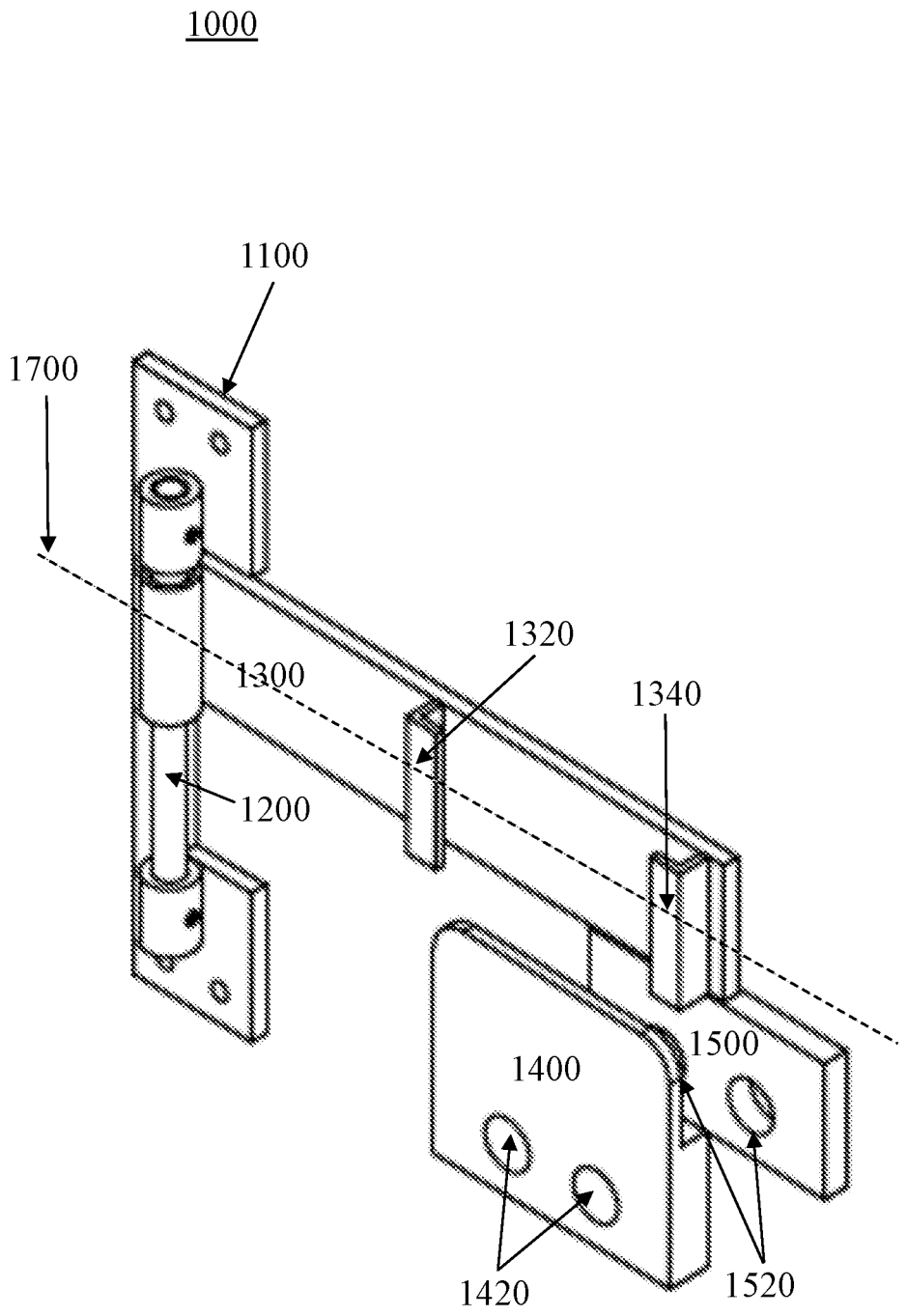
FIG. 1 is a perspective view of an exemplary embodiment of a system 1000.

FIG. 1 is a perspective view of an exemplary embodiment of a system 1000, which comprises:

- a door;
- a schoollock-mount 1100 coupleable to a doorframe of a door;
- a schoollock-pin 1200 slidably coupleable to the schoollock-mount;
- a schoollock-arm 1300 slidably coupleable to schoollock-pin 1200;
- a schoollock-door-latch 1400; and/or
- a schoollock-door-brace 1500.

Schoollock-door-latch 1400 defines one or more schoollock-door-latch apertures 1420. Schoollock-door-latch 1400 is coupleable to the door via one or more schoollock-door-latch apertures 1420.

When schoollock-mount 1100 is coupled to the doorframe of the door and schoollock-pin 1200 and schoollock-arm 1300 are coupled to schoollock-mount 1100, the door is lockable via schoollock-arm 1300 engaging with schoollock-door-latch 1400.

Schoollock-arm 1300 can comprise a left angle bracket 1320 and a right angle bracket 1340. When engaged with schoollock-door-latch 1400, left angle bracket 1320 and right angle bracket 1340 are constructed to restrain motion of schoollock-arm 1300 relative to schoollock-door-latch 1400 in either direction parallel to a longitudinal axis 1700 of schoollock-arm 1300.

Schoollock-door-brace 1500 defining one or more schoollock-door-brace apertures 1520. Schoollock-door-brace 1500 is constructed to be coupled to the door via one or more fasteners. The one or more fasteners engage schoollock-door-latch 1400 via one or more schoollock-door-latch apertures 1420.

Figure 2:
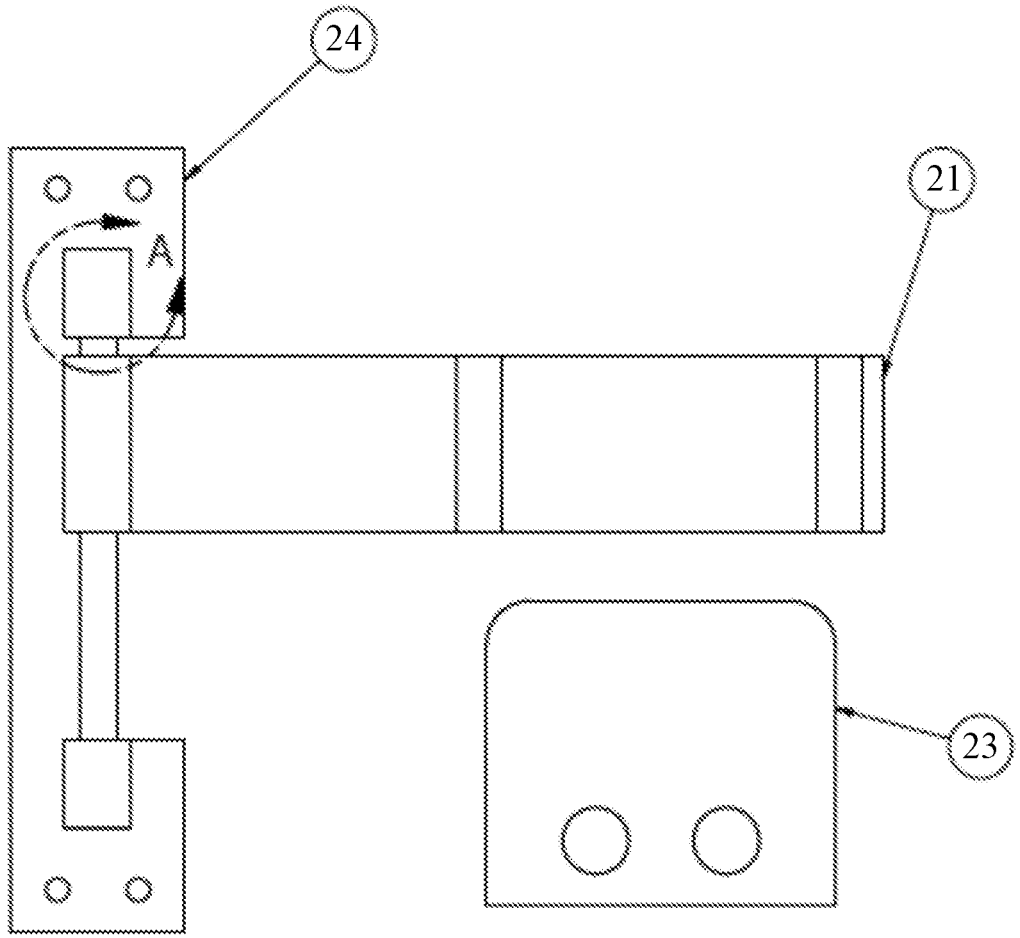
FIG. 2 is a side view of an exemplary embodiment of a system 2000.

FIG. 2 is a side view of an exemplary embodiment of a system 2000, which comprises a schoollock-mount 24, a schoollock-arm 21, and a schoollock-door-latch 23. System 2000 also illustrates a location of a section A.

Figure 3:
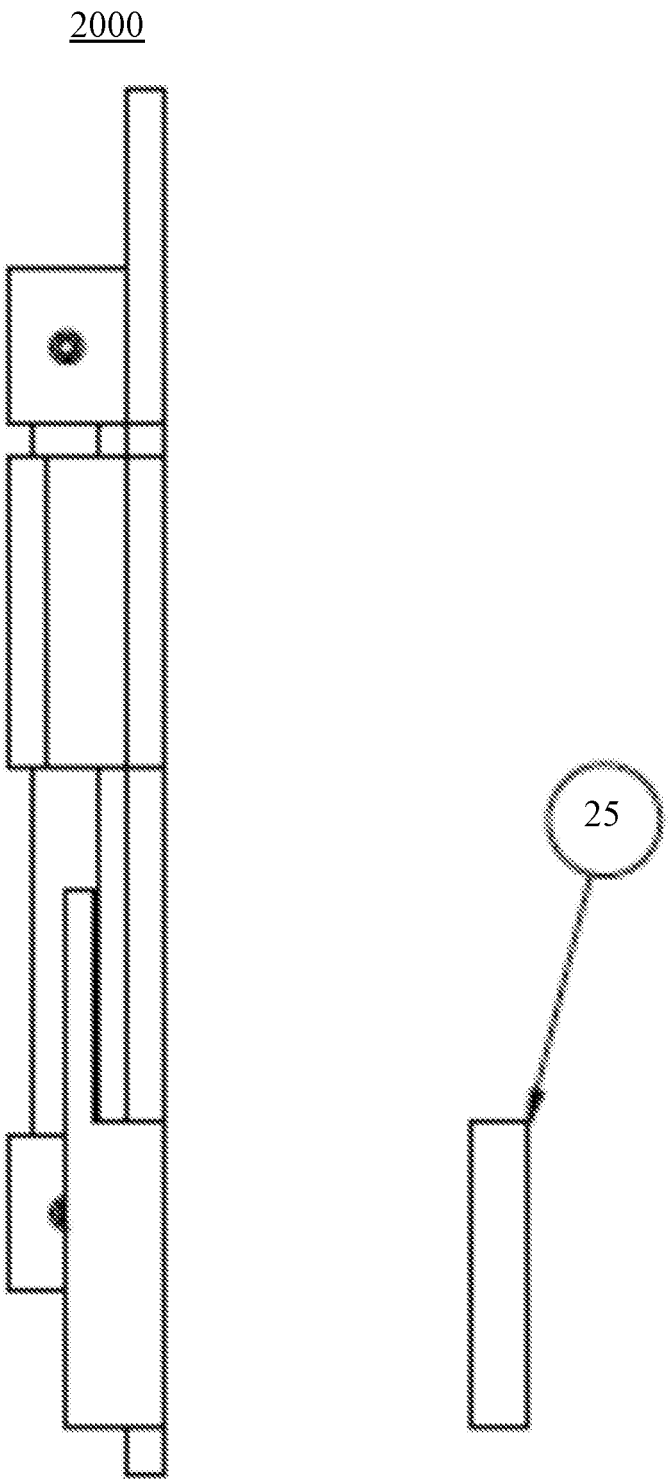
FIG. 3 is an end view of exemplary system 2000.

FIG. 3 is an end view of exemplary system 2000, which comprises a Schoollock-door-brace 25.

Figure 4:
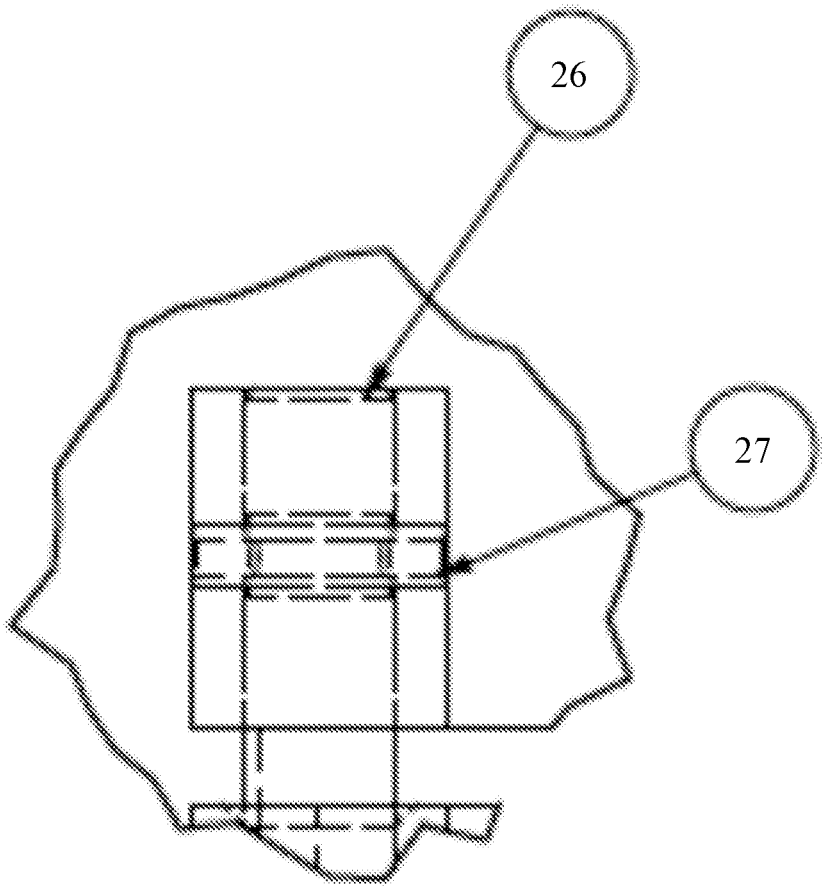
FIG. 4 is a sectional view A from system 2000, as shown in FIG. 2.

FIG. 4 is a sectional view A from system 2000, as shown in FIG. 2, which illustrates a schoollock-pin 26 and a schoollock-rollpin 27.

Figure 5A:
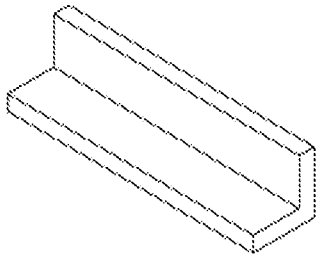
FIG. 5A is a perspective view of an exemplary embodiment of an angle 5000.

FIG. 5A is a perspective view of an exemplary embodiment of an angle 5000.

Figure 5B:
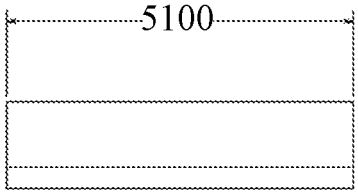
FIG. 5B is a side view of angle 5000.

FIG. 5B is a side view of angle 5000, which is characterized by a length 5100. Length 5100 can vary depending upon the size of the lock on which it is used. Certain exemplary embodiments can be approximately 2 inches in length.

Figure 5C:
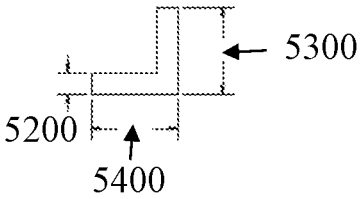
FIG. 5C is an end view of angle 5000.

FIG. 5C is an end view of angle 5000, which is further characterized by a thickness 5200, an angle height 5300, and an angle width 5400. Thickness 5200, angle height 5300, and angle width 5400 can vary depending upon application. In certain exemplary embodiments, thickness 5200 can be approximately 0.13 inches, angle height 5300 can be approximately 0.5 inches, and angle width 5400 can be approximately 0.5 inches.

Figure 6B:
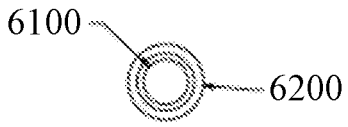
FIG. 6B is a plan view of schoollock-arm-knuckle 6000.
Figure 6A:
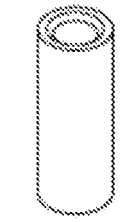
FIG. 6A is a perspective view of an exemplary embodiment of a schoollock-arm-knuckle 6000.

FIG. 6A is a perspective view of an exemplary embodiment of a schoollock-arm-knuckle 6000.

FIG. 6B is a plan view of schoollock-arm-knuckle 6000, which is characterized by an inner diameter 6100 and an outer diameter 6200. Inner diameter 6100 and outer diameter 6200 can vary by application. In certain exemplary embodiments, inner diameter 6100 can be approximately 0.4475 inches and outer diameter 6200 can be approximately 0.75 inches.

Figure 6C:
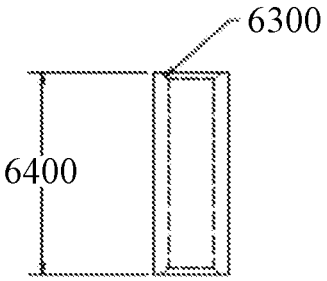
FIG. 6C is a side view of schoollock-arm-knuckle 6000.

FIG. 6C is a side view of schoollock-arm-knuckle 6000, which is characterized by a chamfer 6300 and a height 6400. Chamfer 6300 and height 6400 can have any suitable dimensions. For example, chamfer 6300 can be approximately 2×0.06×45 degrees. In certain exemplary embodiments, height 6400 can be approximately two inches.

Figure 6D:
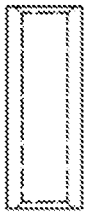
FIG. 6D is a side view of schoollock-arm-knuckle 6000.

FIG. 6D is a side view of schoollock-arm-knuckle 6000.

Figure 7A:
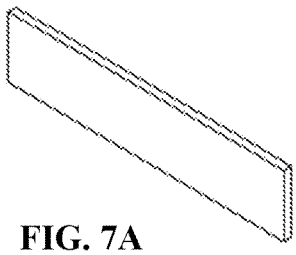
FIG. 7A is a perspective view of an exemplary embodiment of a schoollock-arm-plate 7000.

FIG. 7A is a perspective view of an exemplary embodiment of a schoollock-arm-plate 7000.

Figure 7B:
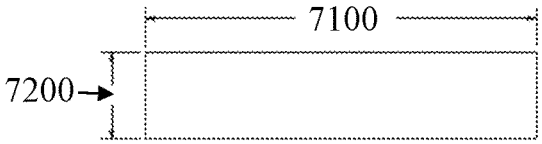
FIG. 7B is a side view of schoollock-arm-plate 7000.

FIG. 7B is a side view of schoollock-arm-plate 7000, which is characterized by a length 7100 and a height 7200. Length 7100 and a height 7200 can have any suitable dimensions. For example, length 7100 can be approximately nine inches and height 7200 can be approximately two inches.

Figure 7C:
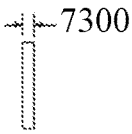
FIG. 7C is an end view of schoollock-arm-plate 7000.

FIG. 7C is an end view of schoollock-arm-plate 7000, which is characterized by a thickness 7300. Thickness 7300 can have any suitable dimension. For example, thickness 7300 can be approximately 0.25 inches.

Figure 8B:
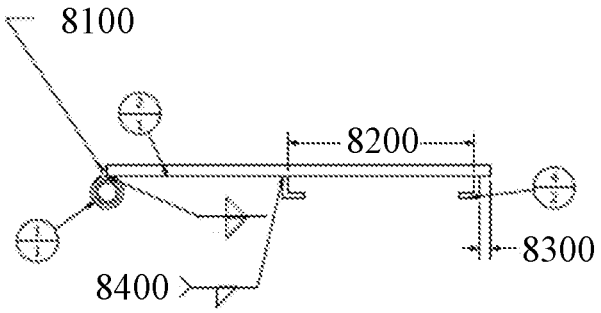
FIG. 8B is a plan view of schoollock-arm 8000.
Figure 8A:
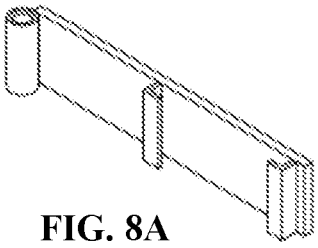
FIG. 8A is a perspective view of an exemplary embodiment of a schoollock-arm 8000.

FIG. 8A is a perspective view of an exemplary embodiment of a schoollock-arm 8000, which comprises a schoollock-arm-knuckle 1, a schoollock-arm-plate 2, and a schoollock-arm-angle 4.

FIG. 8B is a plan view of schoollock-arm 8000, which comprises a schoollock-arm-knuckle 1, a schoollock-arm-plate 2, and a schoollock-arm-angle 4. Schoollock-arm 8000 is characterized by first weld instructions 8100, a bracketed length 8200, an unbracketed length 8300, and second weld instructions 8400. First weld instructions 8100 can instruct a fabricator to grind a weld so that a flat edge can be placed between schoollock-arm-knuckle 1 and schoollock-arm-plate 2. Bracketed length 8200 can have any suitable dimension. For example, bracketed length 8200 can be approximately 0.25 inches. Second weld instructions 8400 can state that two places are to be welded with 0.25 inch welds.

Figure 8C:
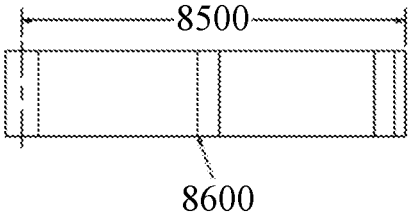
FIG. 8C is a side view of schoollock-arm 8000.

FIG. 8C is a side view of schoollock-arm 8000, which is characterized by a length 8500 and an instruction 8600. Length 8500 can have any suitable dimension. For example, length 8500 can be approximately nine inches. Instruction 8600 can instruct a fabricator that schoollock-arm-angle 4 is to be flush to vertically centered on schoollock-arm-plate 2.

Figure 8D:
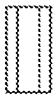
FIG. 8D is an end view of schoollock-arm 8000.

FIG. 8D is an end view of schoollock-arm 8000.

Figure 9B:
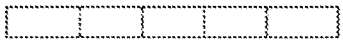
FIG. 9B is a plan view of schoollock-door-brace 9000.
Figure 9A:
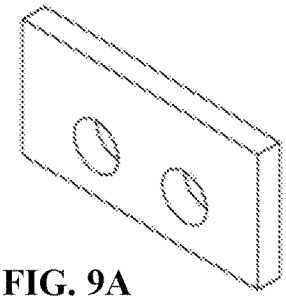
FIG. 9A is a perspective view of an exemplary embodiment of a schoollock-door-brace 9000.

FIG. 9A is a perspective view of an exemplary embodiment of a schoollock-door-brace 9000.

FIG. 9B is a plan view of schoollock-door-brace 9000.

Figure 9C:
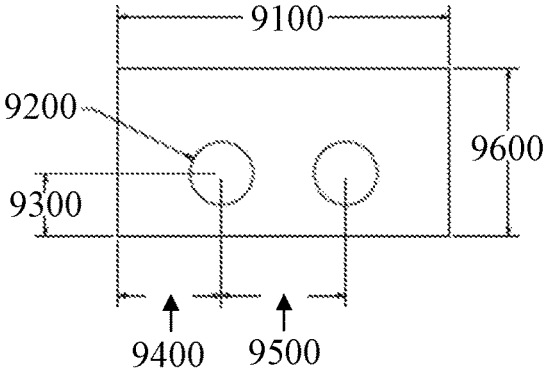
FIG. 9C is a side view of schoollock-door-brace 9000.

FIG. 9C is a side view of schoollock-door-brace 9000, which is characterized by a length 9100, a diameter 9200, a height 9300, a width 9400, a width 9500, and a height 9600. Each dimension of schoollock-door-brace 9000 can have any suitable dimension. For example, length 9100 can be approximately 4 inches, diameter 9200 can be approximately 0.755 inches, height 9300 can be approximately 0.75 inches, width 9400 can be approximately 1.25 inches, width 9500 can be approximately 1.5 inches, and height 9600 can be approximately 2 inches.

Figure 9D:
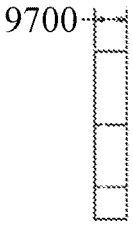
FIG. 9D is an end view of schoollock-door-brace 9000.

FIG. 9D is an end view of schoollock-door-brace 9000, which is characterized by a thickness 9700. Each dimension of schoollock-door-brace 9000 can have any suitable dimension. For example, thickness 9700 can be approximately 0.38 inches.

Figure 10B:
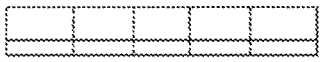
FIG. 10B is a plan view of schoollock-door-latch 10000.
Figure 10C:
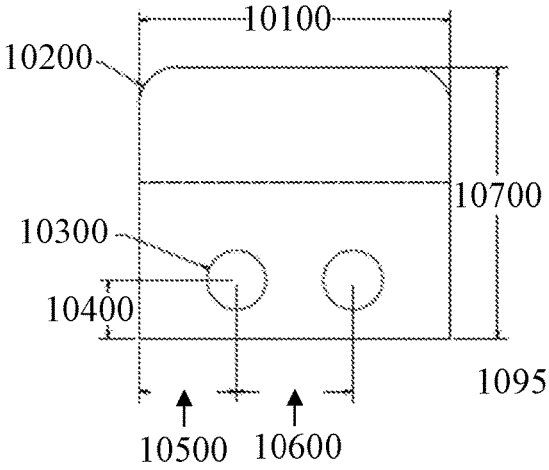
FIG. 10C is a side view of schoollock-door-latch 10000.
Figure 10D:
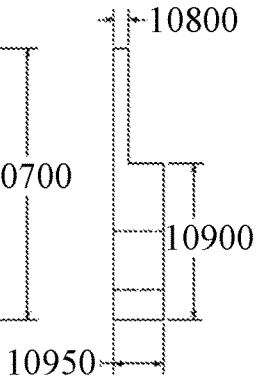
FIG. 10D is an end view of schoollock-door-latch 10000.
Figure 10A:
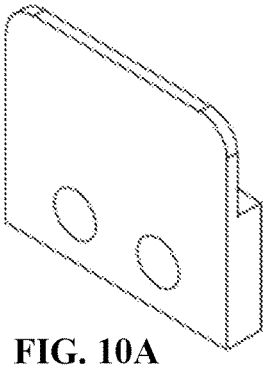
FIG. 10A is a perspective view of an exemplary embodiment of a schoollock-door-latch 10000.

FIG. 10A is a perspective view of an exemplary embodiment of a schoollock-door-latch 10000.

FIG. 10B is a plan view of schoollock-door-latch 10000.

FIG. 10C is a side view of schoollock-door-latch 10000, which is characterized by a length 10100, a curvature 10200, a diameter 10300, a height 10400, a width 10500, a width 10600, and a height 10700. Each dimension of schoollock-door-latch 10000 can have any suitable dimension. For example, length 10100 can be approximately 4 inches, diameter 10300 can be approximately 0.76 inches, height 10400 can be approximately 0.75 inches, width 10500 can be approximately 1.25 inches, width 10600 can be approximately 1.5 inches, and height 10700 can be approximately 3.5 inches. In certain exemplary embodiments, curvature 10200 can have an approximate radius of approximately 0.5 inches.

FIG. 10D is an end view of schoollock-door-latch 10000, which is characterized by a thickness 10800, a height 10900, and a width 10950. Each dimension of schoollock-door-latch 10000 can have any suitable dimension. For example, thickness 10800 can be approximately 0.188 inches, height 10900 can be approximately two inches, and width 10950 can be approximately 0.63 inches.

Figure 11B:
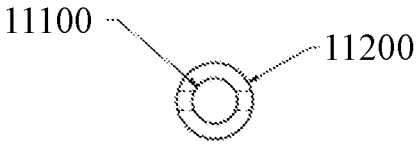
FIG. 11B is a plan view of schoollock-mount-knuckle 11000.
Figure 11A:
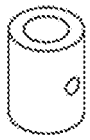
FIG. 11A is a perspective view of an exemplary embodiment of a schoollock-mount-knuckle 11000.

FIG. 11A is a perspective view of an exemplary embodiment of a schoollock-mount-knuckle 11000.

FIG. 11B is a plan view of schoollock-mount-knuckle 11000, which is characterized by an inner diameter 11100 and an outer diameter 11200. Each dimension of schoollock-mount-knuckle 11000 can have any suitable dimension. For example, inner diameter 11100 can be approximately 0.4475 inches, outer diameter 11200 can be approximately 0.75 inches.

Figure 11C:
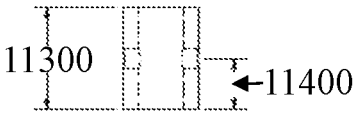
FIG. 11C is a side view of schoollock-mount-knuckle 11000.

FIG. 11C is a side view of schoollock-mount-knuckle 11000, which is characterized by a height 11300 and a height 11400. Each dimension of schoollock-mount-knuckle 11000 can have any suitable dimension. For example, height 11300 can be approximately one inch, and height 11400 can be approximately 0.5 inches.

Figure 11D:
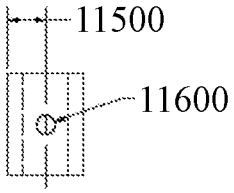
FIG. 11D is an end view of schoollock-mount-knuckle 11000.

FIG. 11D is an end view of schoollock-mount-knuckle 11000, which is characterized by a radius 11500 and a diameter 11600. Each dimension of schoollock-mount-knuckle 11000 can have any suitable dimension. For example, radius 11500 can be approximately 0.375 inch, and diameter 11600 can be approximately 0.187 inches.

Figure 12B:
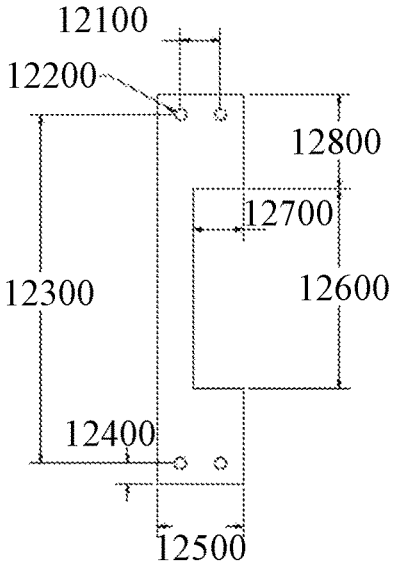
FIG. 12B is a side view of schoollock-mount-plate 12000.
Figure 12C:
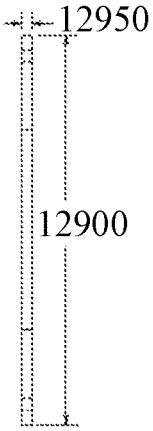
FIG. 12C is an end view of schoollock-mount-plate 12000.
Figure 12A:
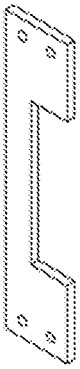
FIG. 12A is a perspective view of an exemplary embodiment of a schoollock-mount-plate 12000.

FIG. 12A is a perspective view of an exemplary embodiment of a schoollock-mount-plate 12000.

FIG. 12B is a side view of schoollock-mount-plate 12000, which is characterized by an aperture spacing 12100, a diameter 12200, a height 12300, a spacing 12400, a width 12500, a notch height 12600, a notch width 12700, and a web height 12800. Each dimension of schoollock-mount-plate 12000 can have any suitable dimension. For example, aperture spacing 12100 can be approximately 0.925 inch, diameter 12200 can be approximately 0.265 inches, height 12300 can be approximately 8.05 inches, spacing 12400 can be approximately 0.475 inches, width 12500 can be approximately two inches, a notch height 12600 can be approximately 4.626 inches, a notch width 12700 can be approximately 1.18 inches, and a web height 12800 can be approximately 2.19 inches.

FIG. 12C is an end view of schoollock-mount-plate 12000, which is characterized by a height 12900 and a thickness 12950. Each dimension of schoollock-mount-plate 12000 can have any suitable dimension. For example, height 12900 can be approximately nine inches, and thickness 12950 can be approximately 0.25 inches.

Figure 13B:
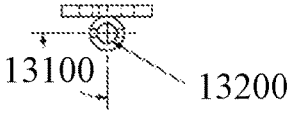
FIG. 13B is a plan view of schoollock-mount 13000.
Figure 13A:
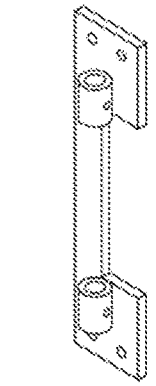
FIG. 13A is a perspective view of an exemplary embodiment of a schoollock-mount 13000.

FIG. 13A is a perspective view of an exemplary embodiment of a schoollock-mount 13000.

FIG. 13B is a plan view of schoollock-mount 13000, which is characterized by an angle 13100 and an instruction 13200. Each parameter of schoollock-mount 13000 can have any suitable value. For example, angle 13100 can be approximately ninety degrees. Instruction 13200 can direct a fabricator that a schoollock-pin must pass through after welding.

Figure 13C:
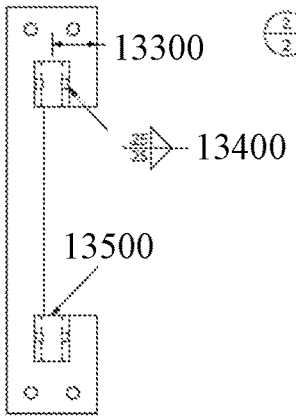
FIG. 13C is a side view of schoollock-mount 13000.

FIG. 13C is a side view of schoollock-mount 13000, which is characterized by a spacing 13300 a weld instruction 13400, and a fabrication instruction 13500. Each parameter of schoollock-mount 13000 can have any suitable value. For example, spacing 13300 can be approximately one inch. Weld instruction 13400 can direct welds in two places. Fabrication instruction 13500 can direct a fabricator to install knuckles flush to an overhanging cutout.

Figure 13D:
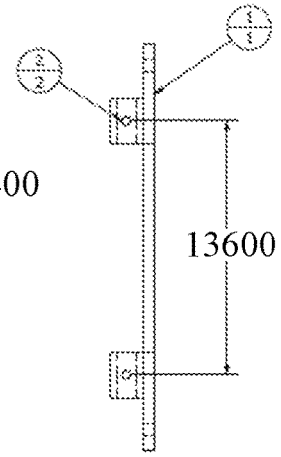
FIG. 13D is an end view of schoollock-mount 13000.

FIG. 13D is an end view of schoollock-mount 13000, which is characterized by a height 13600. Each dimension of schoollock-mount 13000 can have any suitable dimension. For example, height 13600 can be approximately 5.626 inches.

Figure 14B:
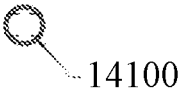
FIG. 14B is a plan view of schoollock-pin 14000.
Figure 14C:
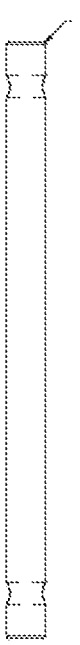
FIG. 14C is a side view of schoollock-pin 14000.
Figure 14D:
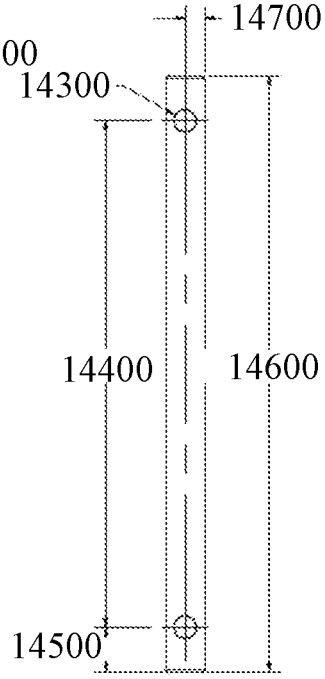
FIG. 14D is an end view of schoollock-pin 14000.
Figure 14A:
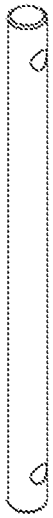
FIG. 14A is a perspective view of an exemplary embodiment of a schoollock-pin 14000.

FIG. 14A is a perspective view of an exemplary embodiment of a schoollock-pin 14000.

FIG. 14B is a plan view of schoollock-pin 14000, which is characterized by a diameter 14100. Each dimension of schoollock-pin 14000 can have any suitable dimension. For example, diameter 14100 can be approximately 0.4375 inches.

FIG. 14C is a side view of schoollock-pin 14000, which is characterized by a chamfer 14200. Each dimension of schoollock-pin 14000 can have any suitable dimension. For example, chamfer 14200 can be approximately 45 degrees.

FIG. 14D is an end view of schoollock-pin 14000, which is characterized by a diameter 14300, a spacing 14400, a spacing 14500, a height 14600, and a radius 14700. Each dimension of schoollock-pin 14000 can have any suitable dimension. For example, diameter 14300 can be approximately 0.25 inch, spacing 14400 can be approximately 5.626 inches, spacing 14500 can be approximately 0.5 inches, height 14600 can be approximately 6.63 inches, and radius 14700 can be approximately 0.219 inches.

Door securing hardware has been developed in many forms from door handle locks that have thumb turns, integrally installed dead bolts, independent door closure arm securing pipes, independent floor model door stops, independent bars that lock into place across the full width of doors, independent door magnetic locks integrated with badge access systems, independent panic hardware type systems, and keyed door locks of various natures and operational methodologies.

Certain exemplary embodiments address functional needs and intents of use. Certain exemplary embodiments can be applied in the event of emergent situations where timeliness is critical. Certain exemplary embodiments provide for improved door security. Certain exemplary embodiments can be readily available and/or permanently mounted to eliminate any possibility of error in use. Certain exemplary embodiments can be usable for maximum effectiveness in a relatively short amount of time. Certain exemplary embodiments can be installed without special tools. Certain exemplary embodiments do not require specialized knowledge to operate. Certain exemplary embodiments can secure a door at multiple locations to maximize the strength of the most vulnerable part of any door that swings open, and that is the non-hinge side (thus the part of the door that opens up).

Certain exemplary embodiments comprise one or more schoollock-arms, which can be utilized as a set of three: one installed at a top section of a door, one in a middle section of the door, and one on a lower section of the door. The schoollock-arms can be fixedly coupled, move via a swing action and one lift action to place them into position. Once schoollock-arms are placed into position they cannot be undone except by someone in a space one the door side to which the schoollock-arms are coupled. Schoollock-arms can be positioned in a relatively short amount of time. Certain exemplary embodiments utilize the structural integrity of the door in conjunction with the structural integrity of the doorframe, and do not require any special tool or particular knowledge for operation.

Certain exemplary embodiments cannot be unlocked by someone on the side of the door that does not have schoollock-arms.

A door is only as secure as the weakest point at which it is secured. For instance, a dead bolt coupled to a middle section of a door is only strong at the middle section of the door, and only providing the structural integrity of the framework it is inserted into holding back a blunt force of someone trying to enter. For example, kicking a door with a lock or deadbolt can cause a wood frame to splinter apart and thereby gain access to a space otherwise secured by the door.

Certain exemplary doors that are only secured at a top or bottom location can allow force to be used to bend the door in order to gain entry through the door.

Schoollock-arms can use the structural integrity of the overall construction build of a door and frame. In certain exemplary embodiments:

- lockdown sleeves hold a swing rod, which can be secured in 3 ways:
  - they can be bound together (top sleeve to bottom sleeve) via a solid steel bar;
  - a bolt at the top and at the bottom can placed thru a steel plate—then through a structural membrane of the frame and construction material—through to the opposing side steel plate, which utilizes an overall strength of a total construction build for structural integrity of securing devices; and/or
  - fixedly couple them to a door frame with substantially no movement available even under pressure;
- schoollock-arms can be:
  - made of substantially solid steel;
  - lift and/or swing for easy placement;
  - fixedly coupled to lockdown sleeves;

matched to be integrally locked into place by schoolock-door-latchs; and/or can withstand a large amount of force without a single deflection in the steel or in the structural integrity of the system;

schoollock-door-latchs can be:

made of substantially solid steel;

fixedly coupled with thru-bolting as defined with lockdown sleeves; and/or have upside down solid steel "L" shaped angles that when force is applied to the door, which can substantially resist any lateral movement of schoollock-arms;

lockdown systems can utilize the structural integrity of:

a door structure (the full composition of the door construction);

a door frame structure (the full composition of the door frame construction as well as the full composition of the construction methods used for placement of the door frame); and/or structural integrity of solid steel plates.

In certain exemplary embodiments, the structural integrity of the schoollock-arms with the angled steel on the schoolock-door-latches provides excellent resistance to unauthorized access through a door.

In certain exemplary embodiments, a door can be secured via a lift-swing-drop methodology for a locking system.

Certain exemplary embodiments can utilize three points of secure fastening of a door to a frame.

Certain exemplary embodiments cannot be easily manipulated in an attempt to disable the security functionality because of thick solid steel construction.

Certain exemplary embodiments can be fixedly coupled to one or more of:

a top section of a door and frame;

a middle section of the door and frame; and/or a lower section of the door and frame.

By placing exemplary embodiments at each of these three locations, almost all deflections are eliminated that could be seen if force is applied to the door from substantially any angle by an external force.

Certain exemplary embodiments secure a door from being opened from all but these ways:

someone from the inside releases locks;

a door is completely shattered into pieces and destroyed;

a hole is cut into the door for access to release locks; and/or a door frame (and the structural construction methods for install) are completely destroyed—such would involve a relatively high force, Certain exemplary embodiments cannot be released externally and a user must be inside of a room accessed by a door to release the door to be opened.

Certain exemplary embodiments can:

utilize steel of a selected and/or specified thickness;

utilize various forms of bracing to resist lateral movement of bars;

utilize various types of through-bolting system;

utilize various procedural motions for locking and/or unlocking;

utilize shorter or longer schoollock-arms based on selected and/or specified structural criteria;

utilize various types of lift-swing-drop components based on selected and/or specified structural criteria.

For example, certain exemplary embodiments can utilize round bars and/or three sided bars.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof adapter—a device used to effect operative compatibility between different parts of one or more pieces of an apparatus or system.

and/or—either in conjunction with or in alternative to.

angle bracket—a structure that comprises a bar with an L-shaped cross section, wherein the bar is constructed to restrain motion of something relative to the structure.

aperture—an opening in something.

apparatus—an appliance or device for a particular purpose associate—to join, connect together, and/or relate.

can—is capable of, in at least some embodiments.

cause—to produce an effect.

comprising—including but not limited to.

configure—to make suitable or fit for a specific use or situation.

connect—to join or fasten together.

constructed to—made to and/or designed to.

convert—to transform, adapt, and/or change.

couple—to join in some fashion.

create—to bring into being.

define—to establish the outline, form, or structure of device—a machine, manufacture, and/or collection thereof.

direction—a line along which something moves.

door—a movable panel at an entrance to a structure.

doorframe—a structure comprising jambs and a transverse member that encloses sides and a top of a doorway and acts to supporting and partially control positioning of a door.

engage—to be in contact and interact with.

fastener—one (or more) restraints that attach to, extend through, penetrate, and/or hold something. For example, a fastener can be one (or more) bolt and nut assembly, rivet, weldment, nail, screw, peg, staple, clip, buckle, clasp, clamp, hook and loop assembly, adhesive, and/or plastic push rivet, etc. ar fixedly—coupled so as to be firm and substantially not nondestructibly removable.

generate—to create, produce, give rise to, and/or bring into existence.

install—to connect or set in position and prepare for use.

lock—to fasten.

longitudinal axis—a straight line defined parallel to an object's length and passing through a centroid of the object.

may—is allowed and/or permitted to, in at least some embodiments.

method—a process, procedure, and/or collection of related activities for accomplishing something.

parallel—substantially a same distance apart and generally not converging or diverging.

plurality—the state of being plural and/or more than one.

predetermined—established in advance.

provide—to furnish, supply, give, and/or make available.

receive—to get, take, acquire, and/or obtain.

repeatedly—again and again; repetitively.

request—to express a desire for and/or ask for.

schoollock-arm—a band of material coupled to a schoollock-pin, which band of material is constructed to rotate around and slide up and down the schoollock-pin, wherein the band of material is constructed to slidably engage with a schoollock-door-latch.

schoollock-door-brace—a block of material that is coupleable to a schoollock-door-latch.

schoollock-door-latch—a bracket that is fixedly coupleable to a door, the bracket constructed to be engaged with a slidable schoollock-arm.

schoollock-mount—a frame that is coupleable to a doorframe.

schoollock-pin—a rod that couples a schoollock-mount to a schoollock-arm.

select—to make a choice or selection from alternatives.

set—a related plurality.

slide—to move along a surface.

store—to place, hold, and/or retain.

substantially—to a great extent or degree.

support—to bear the weight of, especially from below.

system—a collection of mechanisms, devices, machines, articles of manufacture, processes, data, and/or instructions, the collection designed to perform one or more specific functions.

via—by way of and/or utilizing.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a schoollock-mount coupleable to a doorframe of a door, the schoollock-mount comprising a first end plate, a second end plate, and a plate between the first end plate and the second end plate, the first end plate coupled to a first cylindrical sleeve, the second end plate coupled to a second cylindrical sleeve;

a schoollock-pin slidably coupleable to the schoollock-mount via engagement with the first cylindrical sleeve and the second cylindrical sleeve;

a schoollock-arm, the schoollock arm comprising a third cylindrical sleeve, the schoollock arm slidably coupleable to the schoollock-pin via engagement of the third cylindrical sleeve with the schoollock pin; and a schoollock-door-latch, the schoollock-door-latch defining one or more schoollock-door-latch apertures, the schoollock-door-latch coupleable to the door via the one or more schoollock-door-latch apertures, wherein when the schoollock-mount is coupled to the doorframe of the door and the schoollock-pin and the schoollock-arm are coupled to the schoollock-mount, the door is lockable via the schoollock-arm engaging with the schoollock-door-latch.

2. The system of claim 1, wherein:

the schoollock-arm comprises a left angle bracket and a right angle bracket, wherein when engaged with the schoollock-door-latch, the left angle bracket and the right angle bracket are constructed to restrain motion of the schoollock-arm relative to the schoollock-door-latch in either direction parallel to a longitudinal axis of the schoollock-arm.

3. The system of claim 1, further comprising:

the door.

4. The system of claim 1, further comprising:

a schoollock-door-brace, the schoollock-door-brace defining one or more schoollock-door-brace apertures, the schoollock-door-brace constructed to be coupled to the door via one or more fasteners, the one or more fasteners engaging the schoollock-door-latch via the one or more schoollock-door-latch apertures.

* * * * *